United States Patent [19]

Skrypek et al.

[11] Patent Number: 4,543,883

[45] Date of Patent: Oct. 1, 1985

[54] APPARATUS FOR PRINTING FRUSTOCONICAL ARTICLES

[75] Inventors: John P. Skrypek, Mahwah; Robert Williams, Randolph; James W. Dominico, West Paterson; Albin Rohr, Rockaway, all of N.J.

[73] Assignee: Sun Chemical Corporation, New York, N.Y.

[21] Appl. No.: 175,872

[22] Filed: Aug. 6, 1980

Related U.S. Application Data

[63] Continuation of Ser. No. 917,115, Jun. 19, 1978, abandoned.

[51] Int. Cl.[4] ..... B41F 17/18

[52] U.S. Cl. ..... 101/38 A; 101/7

[58] Field of Search ..... 101/7, 35–44

[56] References Cited

U.S. PATENT DOCUMENTS

| | | | |
|---|---|---|---|
| 296,224 | 4/1884 | Berge | 101/36 |
| 1,827,683 | 10/1931 | Yager | 101/7 |
| 2,484,671 | 10/1949 | Bauman | 101/40 |
| 2,756,671 | 7/1956 | Cope | 101/39 |
| 2,908,218 | 10/1959 | Stephan | 101/38 R |
| 3,543,680 | 12/1970 | Killen | 101/40 |
| 3,598,043 | 8/1971 | Schaff | 101/40 |
| 3,645,201 | 2/1972 | Jackson | 101/38 A |
| 3,960,073 | 6/1976 | Rush | 101/40 |
| 4,043,262 | 8/1977 | Kojimoto | 101/7 |

FOREIGN PATENT DOCUMENTS

| | | | |
|---|---|---|---|
| 1107245 | 5/1961 | Fed. Rep. of Germany | 101/39 |
| 2125103 | 11/1972 | Fed. Rep. of Germany | 101/38 R |

*Primary Examiner*—Clyde I. Coughenour

*Attorney, Agent, or Firm*—Cynthia Berlow; Mitchell D. Bittman

[57] ABSTRACT

Apparatus for applying a plurality of color images to cylindrical or frustoconical articles includes a turret mounting radially extending angularly spaced shafts, each of which mounts a mandrel. The turret is fixed vertically and is moved in angular steps so that each of the mandrels is alternately positioned at printing stations and drying stations. The mandrels are rotated in synchronism with printing rolls located at each of the printing stations. Each printing roll is mounted on an individual auxiliary frame which in turn is mounted to a subframe on a horizontal pivot axis so that the printing roll may be adjusted pivotally to a position wherein its outer surface is aligned with the outer surface of a mandrel. The subframe is vertically movable relative to the turret for simultaneously moving all of the printing rolls relative to the mandrels.

4 Claims, 10 Drawing Figures

FIG. 6.
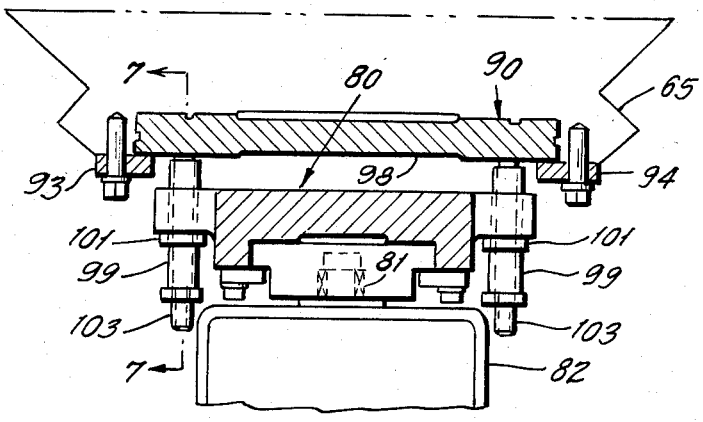
FIG. 7.
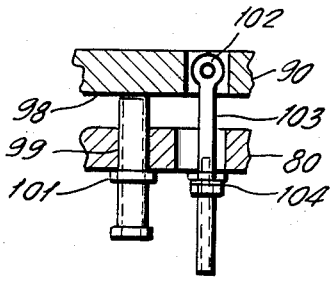
FIG. 8.
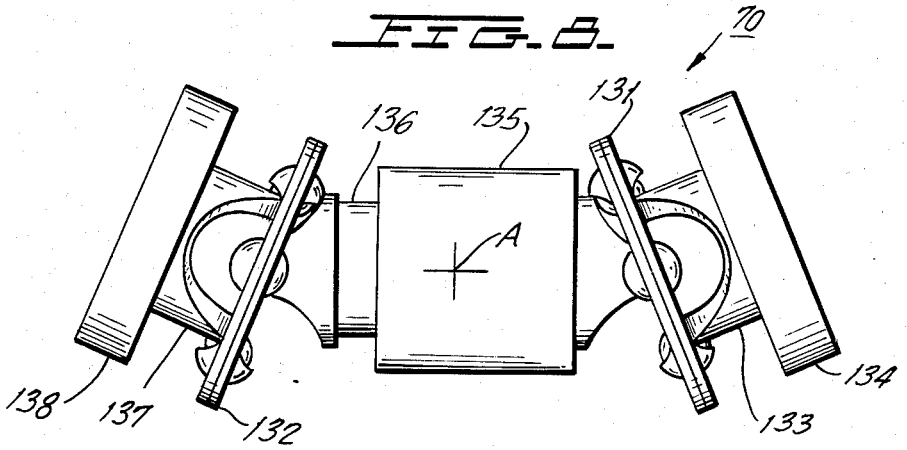
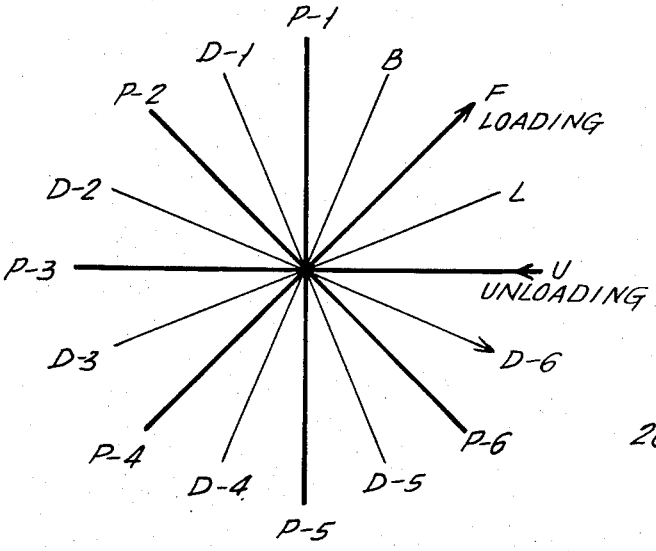
FIG. 10.
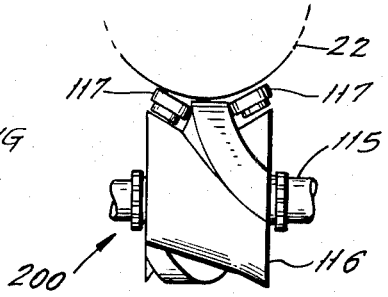
FIG. 9.

APPARATUS FOR PRINTING FRUSTOCONICAL ARTICLES

This is a continuation of U.S. patent application Ser. No. 917,115, filed June 19, 1978, now abandoned.

This invention relates to apparatus for applying multi-colored images to frustoconical or cylindrical containers and is an improvement over this type of apparatus described in U.S. Pat. No. 3,645,201 issued Feb. 29, 1972, to J. M. Jackson for a Multi-Color Printing Machine For Cylindrical and Frustoconical Objects.

The aforesaid U.S. Pat. No. 3,645,201 illustrates printing apparatus in which there are a plurality of print rolls angularly spaced about a main vertical axis. Each roll is rotatably mounted on a rotational axis extending radially from the main axis. Rotatably mounted on the main axis is a turret carrying a plurality of mandrels which support containers during printing thereon by the print rolls. The turret is driven in angular steps and during each dwell period thereof the print rolls are in engagement with a container carried by one of the mandrels. Stepping motion of the turret is synchronized with rotation of the mandrels and print rolls about their respective rotational axes so that the individual images printed by the various print rolls are locted precisely.

A significant drawback to the apparatus described in the aforesaid U.S. Pat. No. 3,645,201 is the extensive time required for changeover when differently sized and/or shaped containers are to be decorated. In addition, for many of these changeover situations the cost of different parts is substantial.

In order to reduce parts and labor costs during changeover the instant invention mounts all of the print rolls and their inkers on a subframe which is vertically adjustable relative to the turret, the latter being in a fixed vertical position. Each print roll and its associated inker are mounted on an auxiliary frame which in turn is connected to the subframe by a horizontal pivot so that the auxiliary frame and elements mounted thereon are pivotally adjustable. The rotational drive train for each of the print rolls includes a double universal joint assembly having an expandable shaft for accommodating different angular positions of the shaft which depend upon spacial relationships between the auxiliary frame and the subframe.

Each of the mandrels is mounted on an individual rotational axis which extends radially from the main axis of the turret. The mandrel rotational axes are in a fixed horizontal plane. Because of this, container loading and unloading positions do not change with a change of container shape and adjustment of the loading and unloading equipment is thereby simplified materially.

Accordingly, a primary object of the instant invention is to provide novel improved multi-color printing apparatus for cylindrical and frustoconical containers.

Another object is to provide apparatus of this type in which adjusting procedures are materially simplified over those required for similar apparatus of the prior art.

Still another object is to provide apparatus of this type in which the rotational axes for the container carrying mandrels are in a fixed horizontal plane.

A further object is to provide apparatus of this type in which the print rollers are mounted on individual auxiliary frames which in turn are individually mounted by horizontal pivot axis to a common vertically adjustable subframe.

These objects as well as other objects of this invention shall become readily apparent after reading the following description of the accompanying drawings in which:

FIG. 1 is a vertical cross-section of apparatus constructed in accordance with teachings of the instant invention, taken through lines 1—1 of FIG. 2 looking in the direction of arrows 1—1.

FIGS. 2 and 3 are horizontal cross-sections taken through the respective lines 2—2 and 3—3 of FIG. 1 looking in the directions of the respective arrows 2—2 and 3—3.

Figure 4:
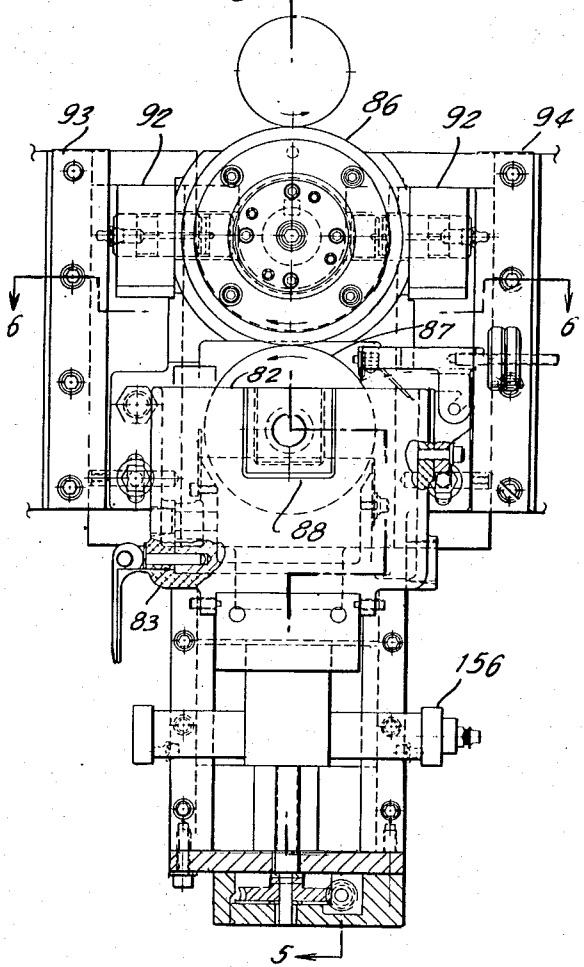
FIG. 4 is a front elevation of one of the printing stations.

FIG. 6 is a fragmentary cross-section taken through the respective lines 5—5 and 6—6 of FIG. 4 looking in the directions of the respective arrows 5—5 and 6—6.

FIG. 7 is a fragmentary cross-section taken through lines 7—7 of FIG. 6 looking in the direction of arrows 7—7.

FIG. 8 is a side elevation of a universal joint assembly.

FIG. 9 is a fragmentary elevation of an intermittent drive mechanism.

FIG. 10 is a diagram illustrating the activities at each dwell position or station.

Figure 1:
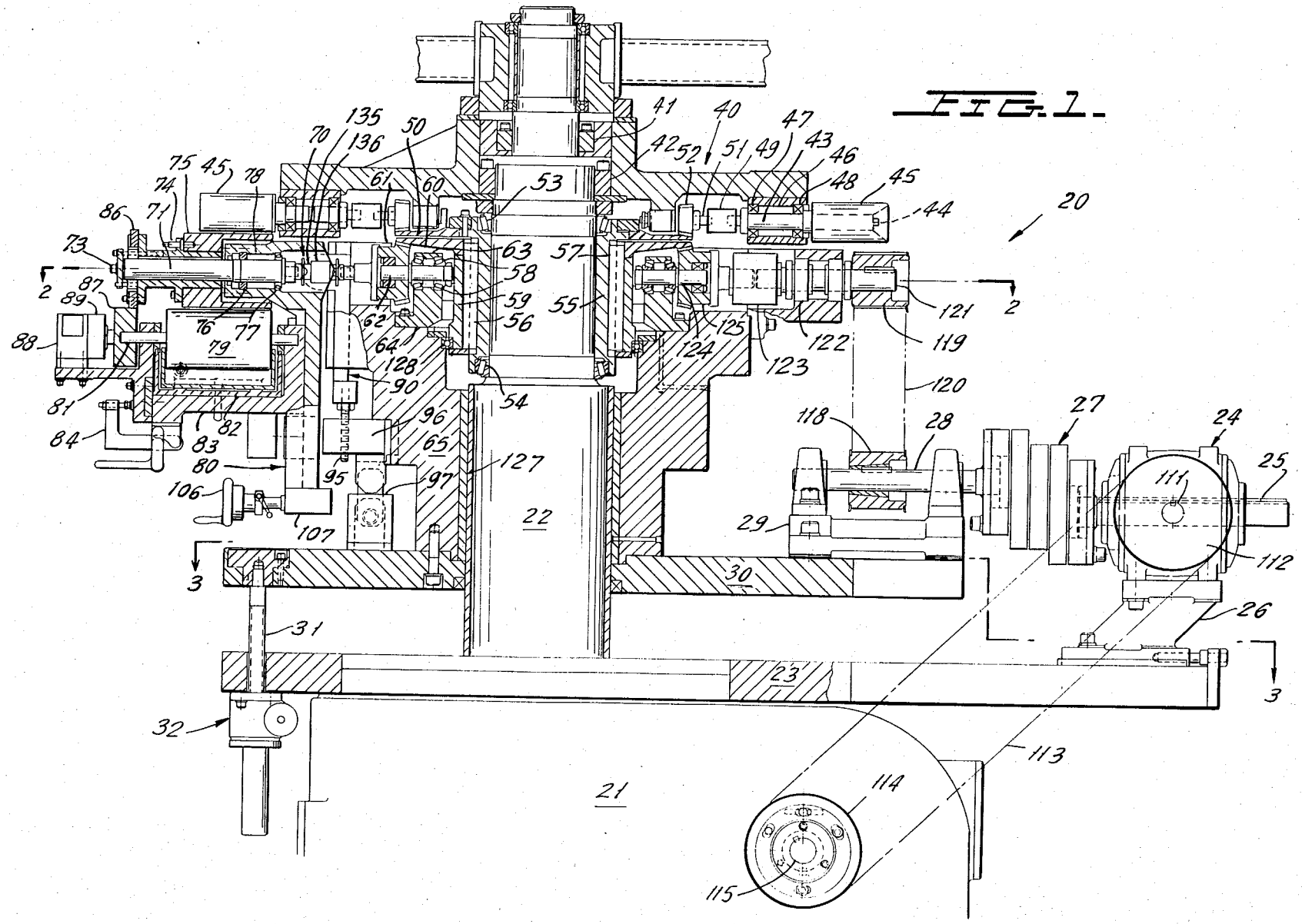
Figure 2:
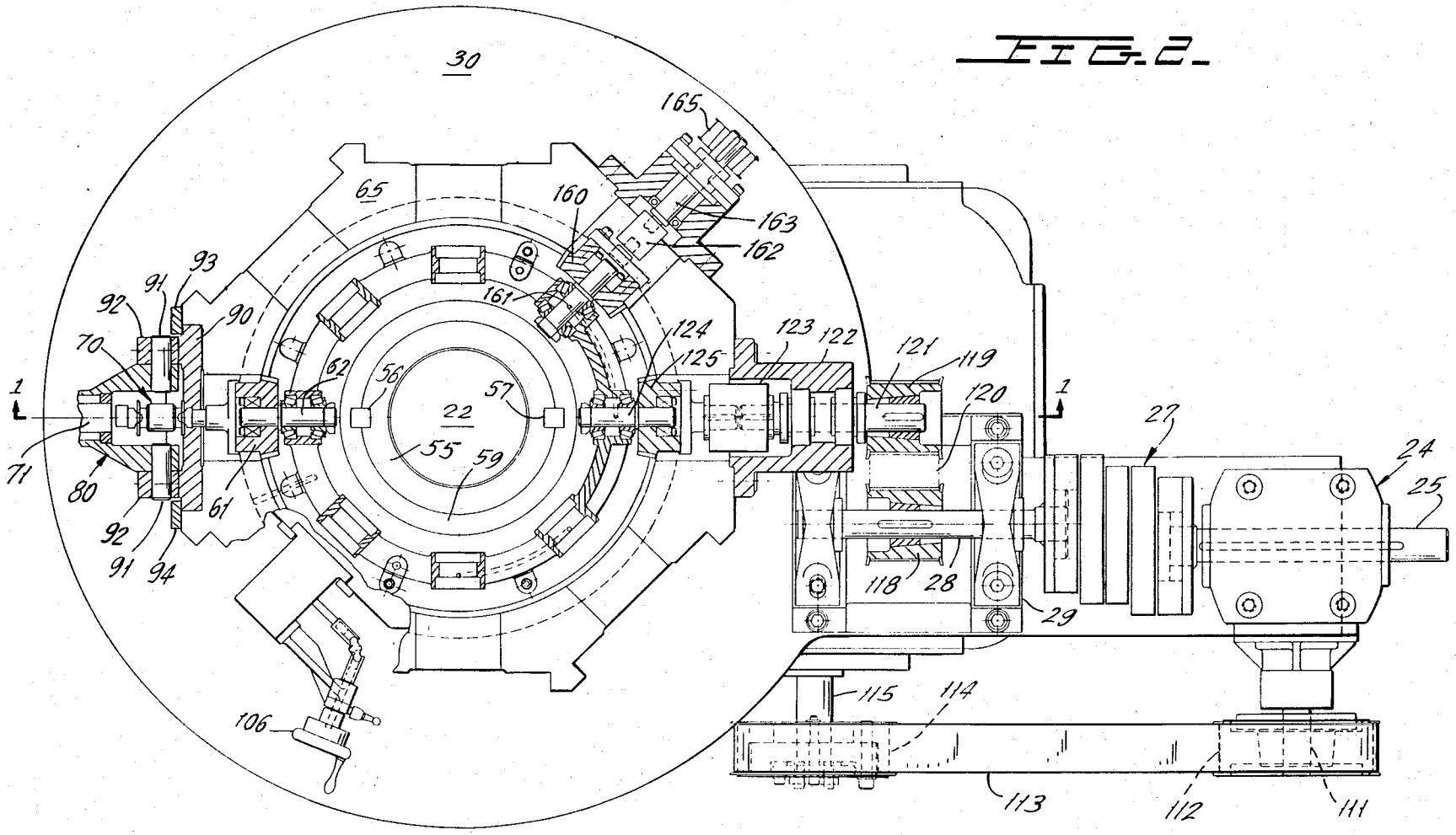
Figure 3:
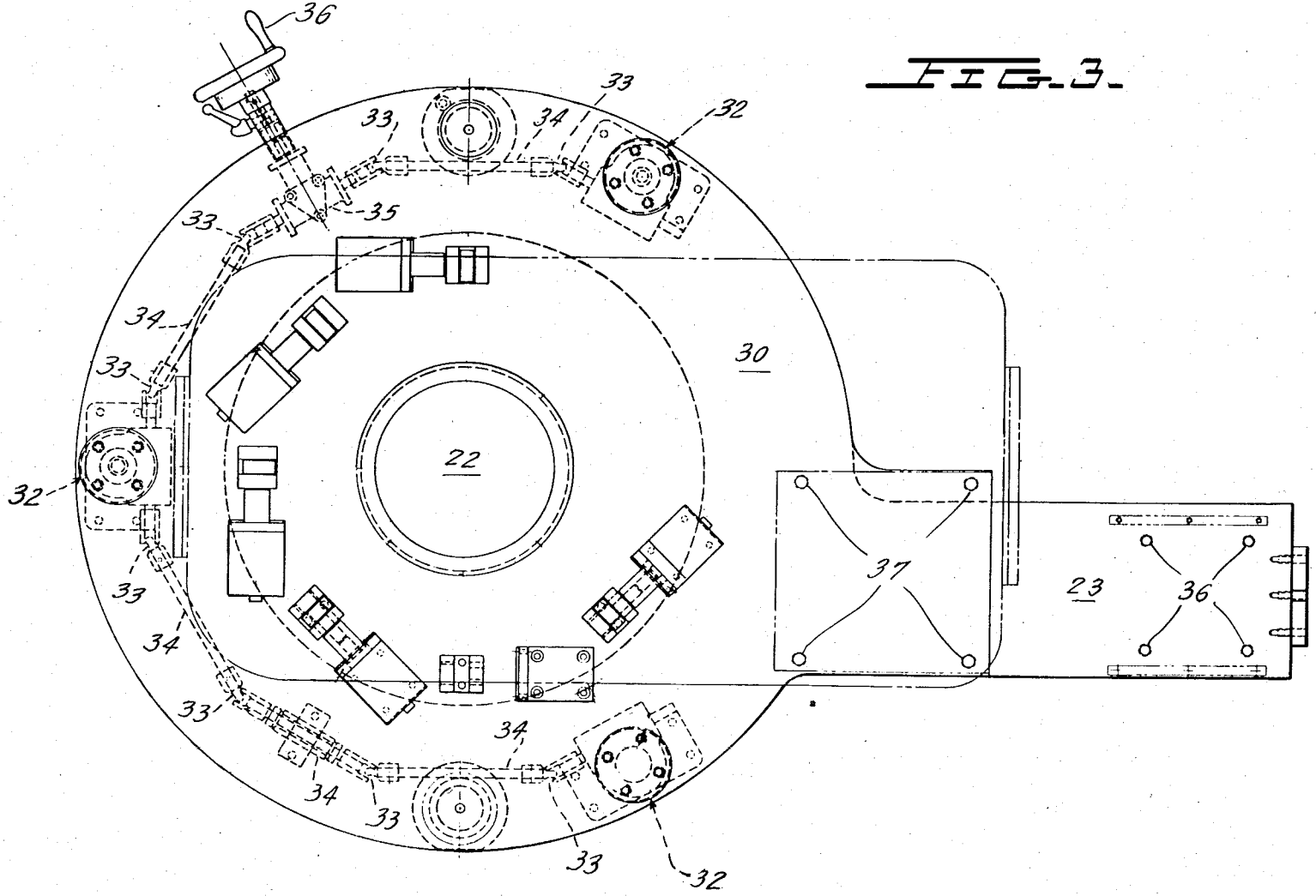

Now referring to the figures and more particularly to FIGS. 1 through 3. Decorating apparatus 20 of FIG. 1 includes a hollow base 21 constituting part of a fixed frame which houses intermittent drive mechanism 200 (FIG. 9) and rotatably supports vertically extending main shaft 22. Fixedly supported at the top of base 21 is fixed horizontal frame plate 23 which supports transmission 24. Bracket means 26 is interposed between transmission 24 and fixed plate 23. Output shaft 25 of transmission 24 drives the input of displacement coupling 27 whose output drives shaft 28 rotatably mounted in bearings supported by the spaced arms of U-shaped bracket 29. The latter is secured to the top side of vertically movable horizontal plate 30 which constitutes a subframe. The four apertures 36 (FIG. 3) receive bolts for securing bracket 26 to plate 23, and the four apertures 37 (FIG. 3) receive bolts for securing bracket 29 to subframe plate 30.

Plate 30 is supported by the upper ends of three screws 31 which extend upwardly from three identical jacking devices 32 supported on the underside of fixed plate 23. As seen in FIG. 3, the three jacking devices are interconnected for simultaneous operation by means of a plurality of universal joints 33, a plurality of stub shafts 34 and a single input coupling device 35 having a manually operable crank 36 through which operating forces are applied to jacking units 32 for raising and lowering subframe 30 relative to stationary frame plate 23.

Turret 40 (FIG. 1) is secured to main shaft 22 near its upper end by so-called ring fedder locking devices 41, 42 so that turret 40 is rotationally fixed to shaft 22. Rotationally mounted on turret 40 are sixteen mandrels 45 disposed outboard of turret 40 with equal angular spaces between adjacent mandrels 45. Since each mandrel 45 is mounted to turret 40 and is driven in the same manner, only the mounting and drive for one mandrel 45 will be described.

More particularly, bolt 44 removably secures mandrel 45 to the outboard end of stub shaft 43 which extends radially with respect to main shaft 22 and is disposed in a fixed horizontal plane. Shaft 43 is rotationally mounted in axially spaced bearings 47, 48 mounted in block 46. Coupling 49 provides a driving connection between the inboard end of shaft 43 and the outboard end of rotationally supported stub shaft 51 whose inboard end mounts beveled pinion gear 52. All of the beveled pinions 52 are in mesh with beveled ring gear 50 which is fixedly secured to sleeve 55. The latter is concentrically mounted to main shaft 22 and is rotationally supported thereon by bearings 53, 54 so as to be in a fixed vertical position.

Sleeve 55 extends through another sleeve 59 and is rotationally keyed thereto by vertically extending elongated keys 56, 57. Beveled ring gear 60 is fixedly secured to the upper end of sleeve 59 so as to be rotatable therewith. As will hereinafter be seen, disposed about main shaft 22 in fixed angular positions with respect thereto are six print stations P-1, P2, etc. (FIG. 10). The elements at each of these print stations P-1, P-2, etc., are identical and receive their driving power from ring gear 60 by means of an individual beveled pinion gear 61 in mesh with ring gear 60. As will hereinafter be explained, beveled pinion gear 125 (FIG. 2) drives ring gear 60. Gear 61 is secured to the outboard end of stub shaft 62 which extends through bore 63 in ring member 64 secured to the upper end of subframe casting 65. The latter is secured to the upper surface of subframe plate 30 and is provided with a central bore through which main shaft 22 extends. Axially spaced bearings 58, 58 rotationally support shaft 62 on ring member 64. Double universal joint assembly 70, to be hereinafter described, provides a driving connection between pinion 61 and shaft 71 having print roll 75 removably mounted thereon by screw means 73. Control 74 operates an eccentric to move roll 75 radially on shaft 71 for fine register adjustment. The inboard end of shaft 71 is rotationally supported by axially spaced bearings 76, 77 disposed within bore 78 of auxiliary frame 80 to be hereinafter described.

The periphery of print roll 75 is normally in operative engagement with the periphery of inking roll 79 having shaft 81 extending axially therethrough and rotationally supported on bearing portions outboard of ink pan support 82. The latter is removably secured to platform 83 on auxiliary frame 80 by means of clamping device 84. Friction wheel 86 on the outboard end of shaft 71 normally engages friction wheel 87 on shaft 81 to drive ink roll 79; however, in a manner well known to the printing art, when print roll 75 is not in operation, ink roll 79 is separated therefrom and the driving connection between elements 86, 87 is broken. At this time ink roll 75 continues to rotate slowly through the operation of air actuator 88 acting through overriding clutch 89.

Figure 5:
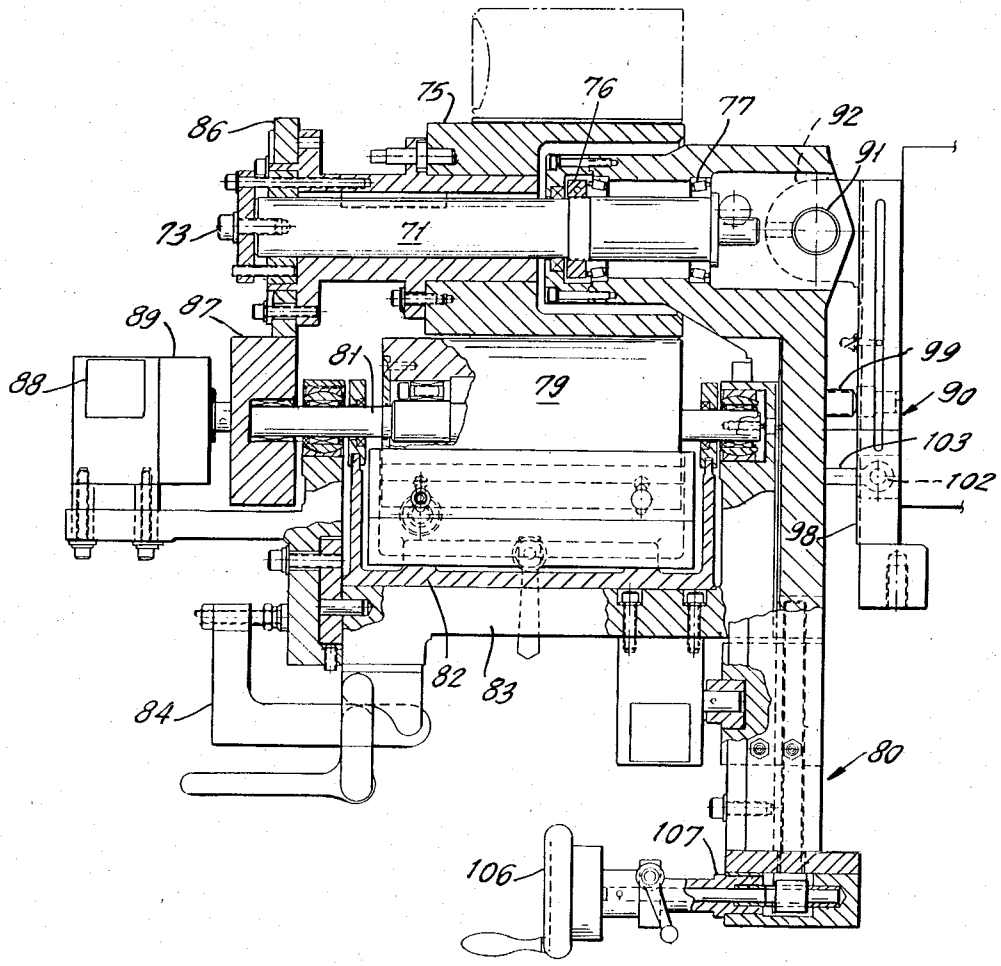
FIG. 5 is a full cross-section.

With particular reference to FIGS. 2, 4, and 5, it is seen that auxiliary frame 80 extends vertically and at its upper end is mounted to horizontally extending pivot 91 consisting of axially aligned sections extending outboard of auxiliary frame 80 into circular apertures in the trunion arms 92, 92 at the upper end of vertically extending reference member 90. The vertical edges of reference member 90 are captured by guide ways 93, 94 secured to casting 65. Projecting upward into a recess at the bottom of member 80 is adjusting screw 95 (FIG. 1) which extends through a threaded aperture in block 96 guided for vertical movement on casting 65. The latter is supported by rotary actuator and eccentric 97' mounted to the upper surface of plate 30. Operation of actuator 97 brings about limited vertical movement of member 90 and pivot 91 connected thereto. Downward movement of member 90 to a no-print position is signaled by the detection of a mandrel which is unloaded or improperly loaded.

The outboard surface 98 (FIG. 5) of member 90 is referred to as the reference surface in that the free end of adjusting screw 99 rests against surface 98 to establish the angular position of auxiliary frame 80 relative to the vertical. Lock nut 101 is provided to hold adjusting screw 99 in adjusted position. Pin 102, extending through the eyelet at the inboard end of bolt 103, pivotally secures the latter to member 90. Bolt 103 extends forward from pin 102 through a clearance aperture in auxiliary frame 80 and threadedly receives nut 104 which abuts the outboard surface of member 80. Thus, it is seen that nut 104 is effective to limit movement of member 80 away from member 90 and adjusting screw 99 is effective to limit movement of member 80 toward member 90. There are two sets of elements 99, 103 for each auxiliary frame 80. As will hereinafter be seen, the angular position of member 80 relative to member 90 is set so that the rotational axis of print roll 75 is parallel to the outer surface of mandrel 45. Hand wheel 106 operates mechanism 107 for raising and lowering support 83 to adjust pressure between ink roll 79 and print roll 75. Air actuator 156 (FIG. 9) is operated automatically to separate ink roll 79 from print roll 75 when rotation of the latter ceases.

Input shaft 111 of transmission 24 is disposed at right angles to shaft 25. Input shaft 115 of intermittent drive 200 (FIG. 9) is driven continuously by a variable speed power source (not shown) and mounts sprocket 114 which drives another sprocket 112 on shaft 111 through closed loop timing belt 113. Drive mechanism 200 produces an intermittent output driving main shaft 22 in equal angular steps of $22\frac{1}{2}°$. A suitable intermittent drive mechanism for this purpose is of the type manufactured by the Ferguson Machine Company of St. Louis, Mo., U.S.A. and is shown in its Catalog No. 160A. Briefly, this type of intermittent drive mechanism 200 includes cam 116 driven by shaft 115 and in engagement with a plurality of rollers 117 mounted on an extended portion of main shaft 22. Cam 116 and rollers 117 cooperate to form a worm gear type drive in that cam 116 is formed as a thread which is modified in such a manner that the rotation of main shaft 22 takes place in accelerated and decelerated annular steps with dwell or rest periods between each of these steps. There are sixteen rollers 117 which act as teeth of a spur gear to rotate main shaft 22 through a complete revolution in sixteen equal angular steps.

Shaft 28 (FIG. 1) drives sprocket 118 which drives sprocket 119 through timing belt 120. Sprocket 119 drives stub shaft 121 extending radially with respect to main shaft 22 and rotationally mounted in bearings supported on extension 122 of casting 65. Coupling 123 connects stub shaft 121 in alignment with stub shaft 124 rotationally mounted to casting extension 64. Beveled pinion 125, identical to pinion gear 61, is mounted on shaft 124 and is in mesh with ring gear 60 to rotate the latter.

As gear 60 rotates about the axis of main shaft 22, sleeve 55 secured to gear 60 is rotated to impart rotation to ring gear 50 so that ring gears 50 and 60 rotate together. When subframe 30 is adjusted (moved vertically), casting 65 moves in unison therewith sliding with respect to main shaft 22 at interface 127. This causes thrust bearing 128 at the bottom of outer sleeve 59 to move vertically. This moves the latter vertically with respect to inner sleeve 55 although sleeves 55, 59 are retained in rotational driving engagement by keys 56, 57.

Universal joint assembly 70 (FIG. 8) includes identical universal joints 131, 132 constructed in a manner well known to the art with means providing mutually perpendicular axes. The input for joint 131 includes slit stub tube 133 having clamping ring 134 thereon and the output of joint 132 includes hollow stub shaft 135. The input for joint 132 includes stub shaft 136 which telescopes inside of shaft 135 and is connected thereto by means (not shown) well known to the art which permits relative axial movement between shaft sections 135, 136 while rotationally keying shaft sections 135, 136 together. The output of joint 132 is provided with slit stub tube 137 having clamping ring 138 mounted thereon. It is noted that horizontal pivot 91 for auxiliary frame 80 extends perpendicular to the axis of shaft 135, 136. When print roll shaft 71 is horizontal the axis of pivot 91 extends through point A located on the axis of shaft 135, 136 and midway between universal joints 131, 132.

As seen in FIG. 2, at infeed station F ring gear 60 drives bevel gear 160 on rotatably mounted on horizontal stub shaft 161 extending radially with respect to main shaft 22. Gear 160 is connected through coupling 162 to drive rotatably mounted stub shaft 163 in axial alignment with shaft 161. At its free end shaft 161 mounts timing sprocket 165 which supplies driving power to a cup in feeding device (not shown).

During operation of decorating apparatus 20, turret 40 moves through sixteen angular steps for each revolution of main shaft 22 so that each mandrel 45 moves through sixteen steps for each revolution of shaft 22, stopping for a substantial period of time between steps; however, during the dwell periods for main shaft 22, the mandrels 45 continue to rotate about their respective rotational axes provided by stub shafts 43 in that ring gear 50 is in continuous motion rotating the sixteen pinions 52 about their rotational axes. At the angular position F (FIG. 10), the mandrel 45 stoped thereat will be loaded with a container having an open end and typically constructed of plastic or metal. In a manner similar to that described in the aforesaid U.S. Pat. No. 3,645,201, suction is applied through passages (not shown) in mandrel 45 to hold a container thereon until the unloading position U is reached. At the first dwell B following the in-feed position F, if the container has been damaged or improperly loaded on mandrel 45 a pressurized air will be applied through mandrel 45 to shed this damaged or improperly loaded container. At the next position P-1, a properly loaded container will have a first color image applied thereto and this image will be dried at the first drying position D-1. Thereafter, this particular mandrel will move alternately to and stop print at printing stations P-2 through P-6 and drying stations D-2 through D-6. Unloading station U follows the last drying station D-6. At the unloading station the vacuum holding forces are discontinued and a blow-off force is applied to remove the decorated container from mandrel 45. At station L located between the unloading station U and the in-feed station F, if the presence of a container is detected the entire apparatus 20 will cease operation and an alarm will sound indicating that a problem condition exists.

Mandrels 45 are illustrated as being cylindrical and are suitable for carrying cylindrical containers; however, when frustoconical containers (those in which the open end is of larger diameter than the closed end) are to be decorated, frustoconical mandrels must be mounted on stub shafts 43. If the printing area on the frustoconical container has a mean diameter substantially that of the cylindrical containers for mandrels 45 then cylindrical print roll 75 may be used, however, the rotational axis 71 for print roll 75 must be adjusted so that it is parallel to the line of contact between roll 75 and the container being decorated. This is accomplished by initially lowering subframe 30 to lower all of the print rolls 75 and then replacing all of the cylindrical mandrels 45 by frustoconical mandrels (not shown). Each of the auxiliary frames 80 is then tilted individually about its respective horizontal axis 91 until the print roll rotational axis 71 is parallel to what will be the line of contact when print roll 75 is in proper printing engagement with the container. After all of the auxiliary frames 80 are in proper tilted positions, jacking devices 32 are operated to raise subframe 30 until there is proper printing engagement between print rolls 75 and the mandrel mounted containers. It is noted that by tilting of auxiliary frame 80 relative axial movement between shaft sections 135, 136 occurs automatically as required to accommodate new positions for universal joints 131, 132.

Although a preferred embodiment of this invention has been described, many variations and modifications will now be apparent to those skilled in the art, and it is therefore preferred that the instant invention be limited not by the specific disclosure herein, but only by the appending claims.

What is claimed is:

1. Apparatus for applying at least two color images to cylindrical or frustoconical articles, said apparatus including a sub-frame and a main frame; a turret mounted on said main frame for rotation about a main axis extending substantially vertical; a plurality of mandrels for supporting articles to which images are to be applied; said mandrels being mounted to said turret in angularly spaced relationship and each of said mandrels being mounted for rotation on an individual mandrel axis extending radially with respect to said main axis; indexing means operable to turn the turret intermittently so as to index each of said mandrels in succession at a plurality of printing stations angularly spaced around the main axis; each of said printing stations mounted on said sub-frame and including a printing roll mounted for rotation about a radially extending rotational axis, inking means for applying ink to said printing roll, an auxiliary frame on which said inking means, said printing roll and means defining said rotational axis are mounted; means defining a substantially horizontal pivot axis about which said auxiliary frame is pivotable relative to said sub-frame to align the outer surface of the printing roll for adjustment thereof to image transferring relation with respect to the outer surfaces of articles mounted on said mandrels; drive means for synchronizing rotation of said mandrels and said printing rolls with each other and with operation of said indexing means; means for bringing about relative substantially vertical adjusting movement between said main frame and said sub-frame to simultaneously adjust gap widths between the outer surfaces of said printing rolls and said mandrels; after said vertical adjusting movement said main frame and said sub-frame remaining stationary as said turret rotates as well as during rotation of said mandrels and said printing rolls; said mandrel axes extending in a common horizontal plane which is fixed in the same vertical position while said turret is turning intermittently as well as while said mandrels are indexed at said printing stations.

2. Apparatus as set forth in claim 1 in which the main frame and the sub-frame are fixed against rotation; said main frame being fixed vertically and said sub-frame being vertically adjustable; said horizontal pivots being mounted to said sub-frame.

3. Apparatus as set forth in claim 1 in which the drive means includes ring gear means, an individual pinion connected to each of said printing rolls to transmit driving power from said ring gear means to said pinions, and an individual coupling means between each of said pinions and the printing roll to which said pinion is connected; said individual coupling including spaced first and second universal joints connected by shaft means disposed generally perpendicular to and extending through the horizontal axis for the auxiliary frame on which said roll is mounted; said shaft means tilting as said auxiliary frame is tilted to accommodate deviation of the rotational axis of said roll from the horizontal; for each of the coupling means, the shaft means being constructed to elongate and contract automatically as required by relative orientation between the universal joints.

4. Apparatus as set forth in claim 3 in which the main frame and the sub-frame are fixed against rotation; said main frame being fixed vertically and said sub-frame being vertically adjustable; said horizontal pivots being mounted to said sub-frame; said ring gear means including first and second drive gears concentric with said main axis and continuously driven by said drive means; means connecting said first drive gear to the plurality of mandrels to rotate the latter about said mandrel axes; said pinions being drivingly connected to said second drive gear to transmit driving power from the latter to rotate said printing rolls about their said rotational axes; said second drive gear being connected to said sub-frame for vertical adjustment therewith relative to said first drive gear while the latter remains fixed in vertical position.

* * * * *